US006296208B1

(12) United States Patent
Franke

(10) Patent No.: US 6,296,208 B1
(45) Date of Patent: Oct. 2, 2001

(54) RAILWAY SWITCH MACHINE POINT DETECTION SYSTEM

(75) Inventor: Raymond C. Franke, Allegheny County, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/382,439

(22) Filed: Aug. 25, 1999

(51) Int. Cl.[7] ..... B61L 5/00
(52) U.S. Cl. ..... 246/220; 246/260; 246/476
(58) Field of Search ..... 246/220, 253, 246/260, 448, 476, 223, 225

(56) References Cited

U.S. PATENT DOCUMENTS 2,740,041 * 3/1956 Marcum ..... 246/220
5,669,587 * 9/1997 Van Alstine et al. ..... 246/220
5,806,809 9/1998 Danner .
6,149,106 * 11/2000 McQuistian ..... 246/220

* cited by examiner

*Primary Examiner*—Mark T. Le
(74) *Attorney, Agent, or Firm*—Kirk D. Houser; David V. Radack; Eckert Seamans Cherin & Mellot, LLC

(57) ABSTRACT

A point detection system for a railway switch machine having a housing includes a point detector bar positionable in a normal point position and a reverse point position, and point detecting sensors positioned within the housing for detecting when the point detector bar is in the normal point position and when the point detector bar is in the reverse point position. The point detecting sensors may include a first proximity sensor for detecting when the point detector bar is in the normal point position and a second proximity sensor for detecting when the point detector bar is in the reverse point position. Preferably, the first proximity sensor and the second proximity sensor are inductive proximity sensors. A method of point detection for a railway switch machine is also provided.

25 Claims, 3 Drawing Sheets

RAILWAY SWITCH MACHINE POINT DETECTION SYSTEM

BACKGROUND OF THE INVENTION

This invention relates to a point detection system for a railway switch machine and an associated method of point detection for a railway switch machine.

As is known in the art, a common method for switching a train from one railroad track to another is to install an electric motor driven switch machine next to the switching point of the track. Current versions of these switch machines are typically operated from a remote location, therefore it is essential that a remote operator be able to determine the position of the switch. In addition, because switch point closure is imperative to safe railroad train operation, Federal Railroad Administration (FRA) rules and regulations mandate not only that the position of the switch points be mechanically locked to prevent the points from opening during train traffic but also that the locked position of the switch points be continuously monitored to detect any undesirable movement.

Prior art switch machines relied on mechanical devices to perform the point and lock detections. However, such mechanical arrangements were subject to degradation over time as a result of wear. In addition, other factors, such as weather, directly affected the reliability of such systems.

U.S. Pat. No. 5,806,809 discloses a railroad switch point position detecting system employing a plurality of proximity detectors positioned proximate to the switch point or points of a railroad switch. These proximity detectors for detecting switch point position are physically located on the switch points or corresponding stock rail. While the use of proximity detectors in general are an improvement over the previous mechanical systems, there are still noted shortcomings of the use thereof. For example, the proximity sensors employed by the '809 patent provides no means to distinguish ON from shorted and OFF from open. Therefore, in a static situation, an ON sensor that shorts will go undetected. If the switch points were subsequently forced open, as would occur with a train running through in the wrong direction, it would go undetected. With the switch points forced open and not reflected in the indication circuit, a safety hazard is created.

There remains a need, therefore, for a point detection system for a railway switch machine that overcomes the disadvantages and shortcomings of the prior art and provides a safe and reliable means for detecting point position.

SUMMARY OF THE INVENTION

The invention has met or exceeded the above-mentioned needs, as well as other needs. The invention includes a point detection system for a railway switch machine having a housing where the point detection system comprises a point detector bar positionable in a normal point position and a reverse point position, and point detecting means positioned within the housing for detecting when the point detector bar is in the normal point position and when the point detector bar is in the reverse point position. Preferably, the point detecting means comprises a first inductive proximity sensor and a second inductive proximity sensor.

In addition, the invention includes a point detection system for a railway switch machine having a housing defining a first sidewall and an opposing second sidewall, a point detector bar with a first and a second end positionable in normal point position and a reverse point position, a slide bar positionable in a normal locked position and a reverse locked position, and an indication system for indicating switching and locking data wherein the point detection system comprises a support sleeve affixed within the housing to the first sidewall and the opposing second sidewall for receiving and slidably supporting the first end of the point detector bar therewithin. The point detection system further comprises an orifice defined in the first sidewall of the housing through which the point detector bar is slidably retained by the first sidewall such that the first end of the point detector bar is slidably captivated within the support sleeve within the housing and the second end of the point detector bar is positioned outside of the housing. The point detection system also comprises a point detector target integrally engaged with the first end of the point detector bar within the housing and a point detecting means positioned within the housing and coupled to the indication system for detecting the point detector target when the point detector bar is positioned in the normal point position and the reverse point position. Furthermore, the point detecting means generates a normal point detection signal that is transmitted to the indication system when the point detecting means detects the point detector target with the point detector bar in the normal point position and the point detector means generates a reverse point detection signal that is transmitted to the indication system when the point detecting means detects the point detector target with the point detector bar in the reverse point position. Preferably, the point detecting means includes at least one inductive proximity sensor.

The invention also includes a method of point detection for a railway switch machine having a housing, a point detector bar positionable in a normal point position and a reverse point position, and a slide lock bar positionable in a normal locked position in a reverse locked position, wherein the method comprises the steps of: providing point detecting means in the housing adjacent to point detector bar; detecting with the point detecting means the position of the point detector bar; generating by the point detecting means a point detection signal representative of the position of the point detector bar; and delivering the point detection signal to means for processing and determining if said point detector bar is in the normal point position, the reverse point position, or in neither the normal point position nor the reverse point position. The method may also include the steps of employing as said point detecting means a first proximity sensor for detecting when the point detector bar is in the normal point position and a second proximity sensor for detecting when the point detector bar is in the reverse point position, and employing as said first proximity sensor and said second proximity sensor inductive proximity sensors.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
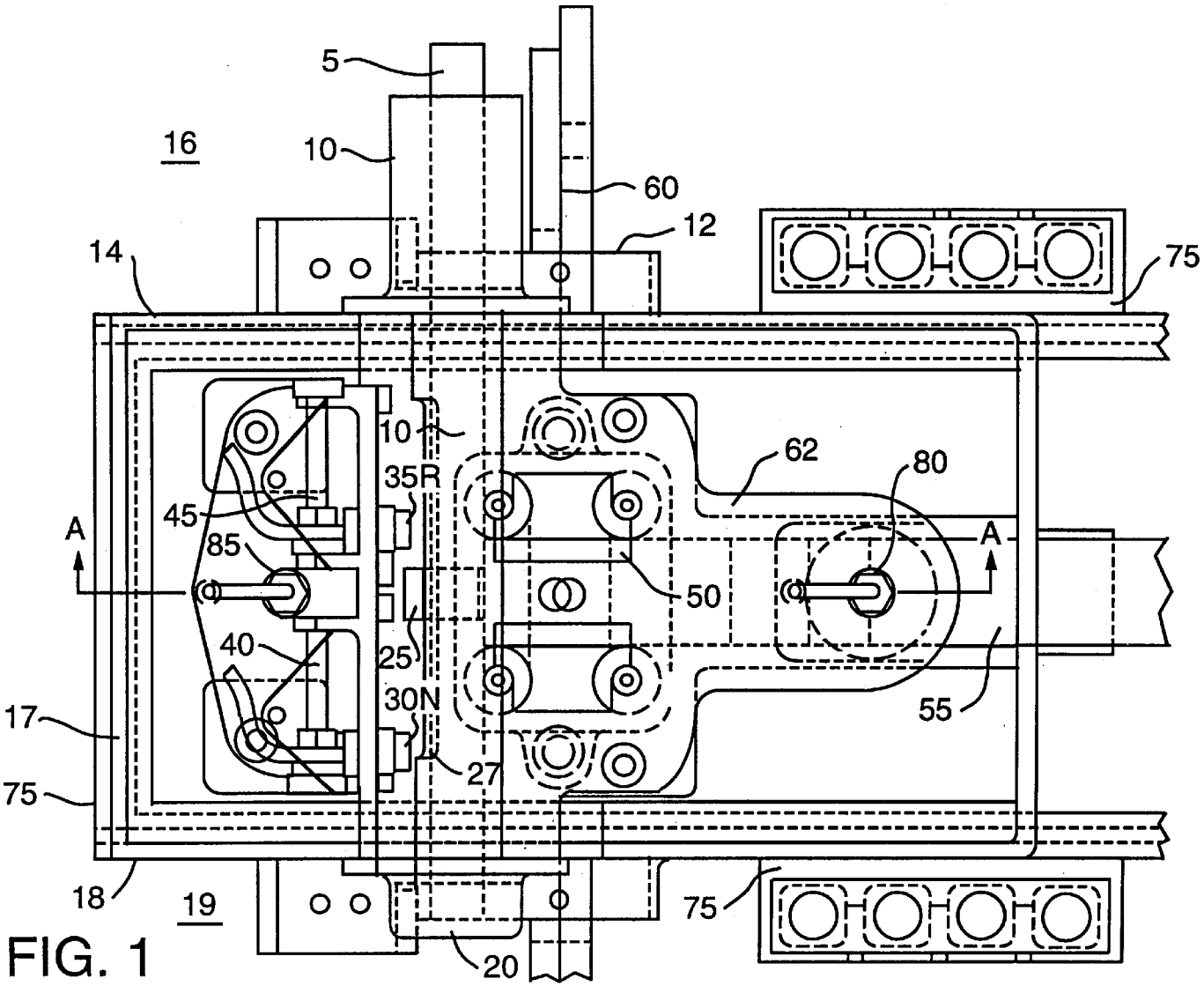
FIG. 1 is a top view of a point detection system positioned within a railway switch machine according to the present invention.
Figure 2:
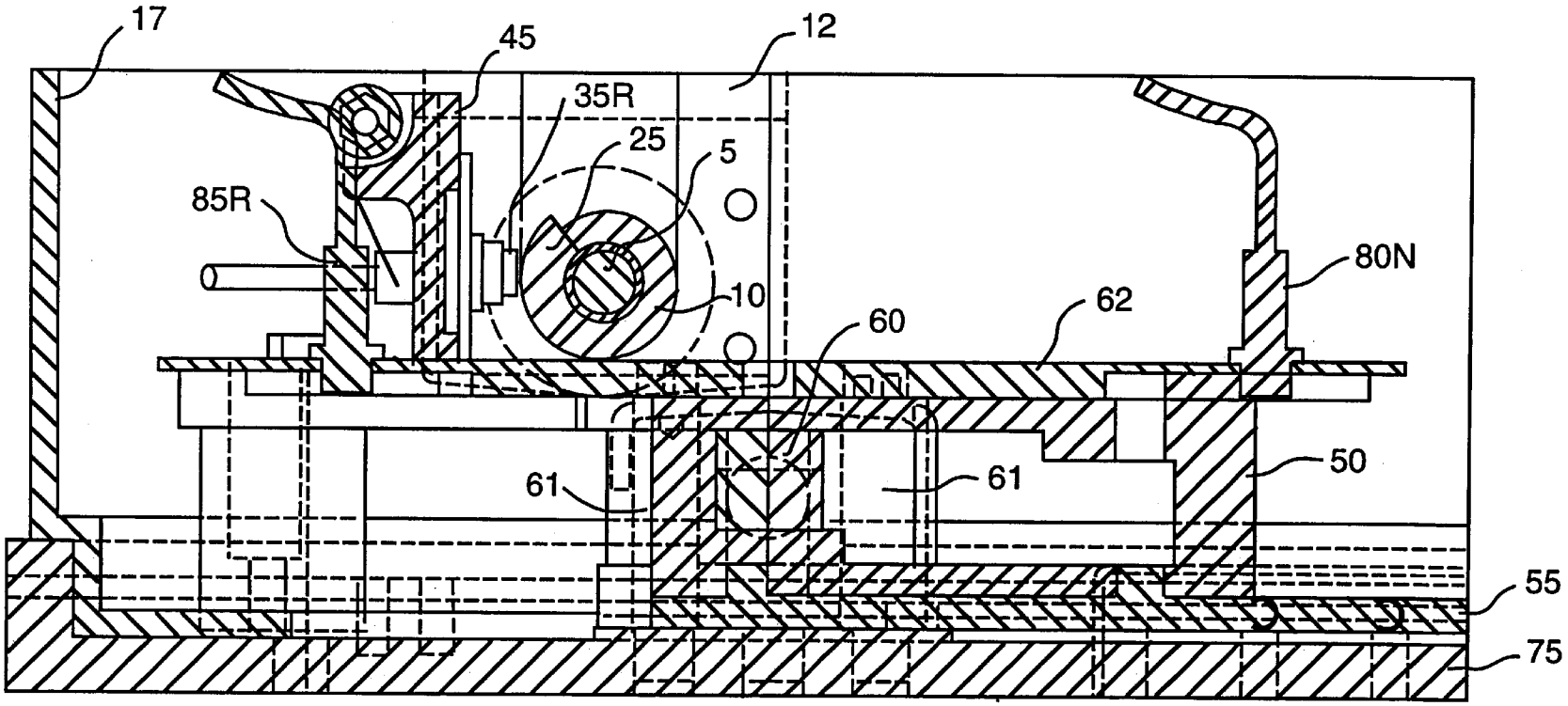
FIG. 2 is a sectional view taken along line A—A of FIG. 1.

Referring to FIGS. 1 and 2, there is shown a point detection system 10 of the present invention as positioned in a railway switch machine. The railway switch machine may be, for example, Union Switch & Signal, Inc., switch machine model number M23E.

A point detector bar 5 (shown partially in phantom in FIG. 1) may be held slidably captive within a point detector sleeve 10 and within a track side bearing 12 mounted to a wall 14 on a track side 16 of a housing 17 of the railway switch machine, so as to support the point detector sleeve 10 and the point detector bar 5. Preferably, the point detector sleeve 10 may extend the internal width of the housing 17 between the wall 14 and a wall 18 on a field side 19 of the housing 17. A field side bearing 20 may be mounted to the wall 18 and may support the point detector sleeve 10. A point detector target 25 may be affixed to the point detector bar 5 and may be exposed to be detected or sensed through a slot 27 defined in the captive point detector sleeve 10.

The point detector bar 5 may be positioned in a normal point position and a reverse point position, as is generally known in the art. The normal point position may be indicated when the point detector bar 5 extends into the point detector sleeve 10 such that the point detector target 25 is more toward the bottom of the slot 27 as shown in FIG. 1. Similarly, the reverse point position may be indicated when the point detector bar 5 extends partially into the point detector sleeve 10 such that the point detector target 25 is more toward the top of the slot 27 as shown in FIG. 1.

In accordance with the present invention, point detecting means are positioned within the housing 17 for detecting when the point detector bar 5 is in the normal point position and for detecting when the point detector bar 5 is in the reverse point position. More specifically, the point detecting means includes a first proximity sensor 30 for detecting the point detector target 25 when the point detector 5 is in the normal point position. Similarly, the point detecting means includes a second proximity sensor 35 for detecting the point detector target 25 when the point detector bar 5 is in the reverse point position. FIG. 1 shows the point detector target 25 and the affixed point detector bar 5 positioned between the normal point position and the reverse point position, but closer to the reverse point position due to the proximity of the point detector target 25 to the second proximity sensor 35.

Preferably, the first proximity sensor 30 and the second proximity sensor 35 are inductive proximity sensors. The use of inductive proximity sensors for determining the position of the point detector bar 5 is advantageous over other types of proximity sensors that have been used for similar purposes, as will be described in more detail herein. An example of an inductive proximity sensor suitable for use with the present invention is a NAMUR inductive proximity sensor TURCK Part No. Bi10-M30-YOX-H1141 or Pepper1+Fuchs Part No. NCB5-18GM40-N0.

To provide for linear adjustment of the first proximity sensor 30 and the second proximity sensor 35 due to a range of possibilities for the normal point position and reverse point position between the slot 27 for a variety of point detector bar 5 connections to various types of switch points (not shown), the invention also provides for first point mounting means for mounting the first proximity sensor 30 in slidable proximity to the point detector target 25 such that the first proximity sensor 30 is slidably adjustable relative to the point detector target 25. In addition, second point mounting means are provided for mounting the second proximity sensor 35 in proximity to the point detector target 25 such that the second proximity sensor 35 is slidably adjustable relative to the point detector target 25. More specifically, the first proximity sensor 30 may be held by a normal linear slide 40, thereby to permit a linear position adjustment of the first proximity sensor 30 with respect to the point detector target 25 in the normal point position. Similarly, the second proximity sensor 35 may be held by a reverse linear slide 45, thereby to permit a linear position adjustment of the second proximity sensor 35 with respect to the point detector target 25 in the reverse point position. Linear slides 40 and 45 may be a commonly known, commercially available linear slide mechanism. Preferably, linear slides 40 and 45 are adapted to mount and adjust an inductive proximity sensor for use with the present invention.

Still referring to FIGS. 1 and 2, there is shown a commonly known lock box 50 that is fixedly mounted to a slide lock or slide bar 55 that mechanically cooperates with a commonly known lock rod assembly 60 to mechanically lock the switch points (not shown). The lock rod assembly 60 rides between and is guided by typical lock rod rollers 61, as shown in FIG. 2. The slide bar 55 rides atop and is guided by a switch machine base 75 through the housing 17 and beneath a frog plate 62 within the housing 17. Preferably, the track side bearing 12 and the field side bearing 20 are mounted directly to the frog plate 62. The slide bar 55, as is generally known, moves linearly along the length of the switch machine base 75 as the switch machine operates, thereby moving the lock box 50, which is fixedly mounted to the slide bar 55, in the same linear fashion. The lock box 50, as is known, is in locking engagement with the lock rod assembly 60 to mechanically prevent the lock rod assembly 60 from moving linearly in a motion perpendicular to the switch machine and the stock rail. This commonly known locking arrangement is typically safety critical. Accordingly, it becomes necessary to detect the linear position of the lock box 50 in order to ensure it is adequately locking the lock rod assembly 60.

The invention also provides for lock detecting means for detecting the lock box 50 that is fixedly mounted to the slide bar 55 to detect when the slide bar 55 is positioned in the normal locked position or the reverse locked position. Of course, it will be appreciated that the lock box 50 acts as a slide bar target and that other types of targets, such as for example, a target similar to the point detector target 25 which is preferably made of a metallic material, may be utilized in conjunction with the invention.

The lock detecting means preferably includes a first proximity sensor 80 for detecting the lock box 50 when the slide bar 55 is positioned in the normal locked position and a second proximity sensor 85 for detecting the lock box 50 when the slide bar 55 is positioned in the reverse locked position. Preferably, the first proximity sensor 80 and the second proximity sensor 85 are inductive proximity sensors. Furthermore, the invention provides for mounting the first proximity sensor 80 and the second proximity sensor 85 in similar linear slides and in a similar manner to the manner in which first proximity sensor 30 and the second proximity sensor 35 are respectively mounted to the linear slides 40 and 45. It will be understood that this permits a linear position adjustment of the first proximity sensor 80 and the second proximity sensor 85 with respect to the lock box 50 or other target positioned on the slide bar 55.

During operation of the railway switch machine and application of the invention, the point detector bar 5 is fixedly connected, typically external to the switch machine, to a commonly known point detector connecting rod (not shown) that is directly connected to the track near the ends of the track switch points (not shown). As the switch machine moves the switch points from the normal position to the reverse position, or vice versa, usually a distance of approximately 4 to 5 inches, the point detector connecting rod and fixedly connected point detector bar are moved the same distance. The point detector bar 5 slides within the track side bearing 12 and within the point detector sleeve 10 where the sleeve 10 captivates the point detector bar 5. Preferably, the point detector sleeve 10 is supported by the track side bearing 10 and the field side bearing 20, each of which may be mounted to the frog plate 62 with a plurality of bolts or similar fasteners (not shown).

As the track switch points move a given distance, the point detector bar 5 moves the same linear distance and in turn moves point detector target 25 the same linear distance. In order to detect and ensure track switch point closure, the linear position of the point detector target 25 is sensed by either the first proximity sensor 30 or the second proximity sensor 35 through the slot 27 defined in the point detector sleeve 10. The first proximity sensor 30 is capable of generating a normal point detection signal in response to detection of the point detector target 25 and, similarly, the second proximity sensor 35 is capable of generating a reverse point detection signal in response to detection of the point detector target 25.

The lock rod assembly 60 is fixedly connected, typically external to the switch machine, near ends of the track switch points. After the switch machine has moved the track switch points from the normal position to the reverse position, or vice versa, the lock box 50 mechanically cooperates with the lock rod assembly 60, as is known in the art, to mechanically lock the switch points. In order to detect and ensure locking of the track switch point closure, the linear position of the lock box 50 is sensed by either the first proximity sensor 80 or the second proximity sensor 85. The first proximity sensor 80 is capable of generating a normal locked detection signal in response to detection of the lock box 50 and the second proximity sensor 85 is capable of generating a reverse locked detection signal in response to detection of the lock box 50.

The first proximity sensor 30 and second proximity sensor 35 (for normal point position and reverse point position) and first proximity sensor 80 and second proximity sensor 85 (for normal locked position and reverse locked position) are coupled with means for processing point detection information and status and lock detection information and status, including an indication system for indicating switching and locking data. Specifically, the proximity sensors may be coupled with a microprocessor 90, or logic controller or similar device that integrates with the railroad's train control signalling systems, as is known in the switch circuit controller art for switch machines. Preferably, these devices may be monitored by a vital microprocessor designed to provide failsafe operation.

The respective normal and reverse point detection signals may be transmitted to typical indication means such as a circuit controller, for example, for indication to railroad personnel or devices. The respective normal locked and reverse locked detection signals may be transmitted to typical indication means, such as a circuit controller, for example, for indication to railway personnel or devices.

Figure 3:
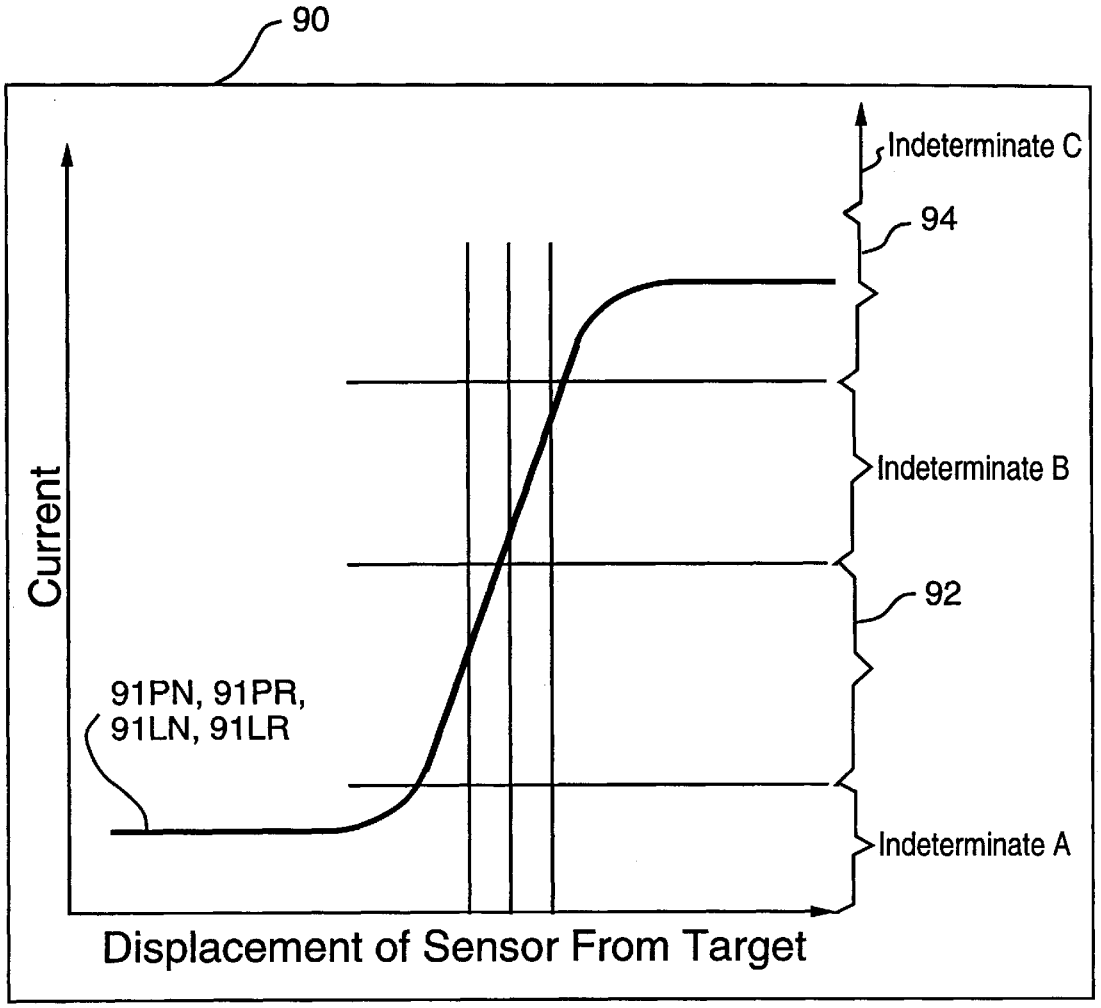
FIG. 3 is a graphical representation of current versus displacement using an inductive proximity sensor in accordance with the invention.

Referring to FIG. 3, there is shown a graphical representation of current versus displacement characteristics of an inductive proximity sensor generated signal for use with the invention. As shown, the graphical representation is produced by the proximity sensors 30 and 35 and communicated to microprocessor 90 which is used for processing and determining point and lock detection status and information.

It will be understood that the curve 91 is typical and representative of the normal point detection signal generated by the first proximity sensor 30, the reverse point detection signal generated by the second proximity sensor 35, the normal locked detection signal generated by the first proximity sensor 80 and the reverse locked detection signal generated by the second proximity sensor 85. More specifically, the normal point detection signal, generally designated by 91PN, is in a first predetermined range 92 to indicate that the point detector bar 5 is in the normal point position. Similarly, the normal point detection signal 91PN is in a second predetermined range 94 to indicate that said point detector bar is not in the normal point position. In addition, the normal point detection signal 91PN is indeterminate of the position of the point detector bar 5 when the normal point detection signal 91PN is less than the first predetermined range and located in the indeterminate A region. Similarly, the normal point detection signal 91PN is indeterminate of the position of the point detector bar 5 when the normal point detection signal 91PN is greater than said first predetermined range 92 but less than said second predetermined range 94 (i.e., within indeterminate B region), or greater than said second predetermined range 94 (i.e., within indeterminate C region). Therefore, it will be appreciated that the use of an inductive proximity sensor to produce the normal point detection signal 91PN provides a safe and reliable means for determining whether the point detector bar 5 is in the normal point position, not in the normal point position or indeterminate of whether the point detector bar 5 is in the normal point position.

Reverse point detection signal 91PR operates in a similar manner as described herein for the normal point detection signal 91PN. Specifically, the reverse point detection signal 91PR is in the first predetermined range 92 to indicate that the point detector bar 5 is in the reverse point position and is in the second predetermined range 94 to indicate that the point detector bar 5 is not in the reverse point position. In addition, the reverse point detection signal 91PR is indeterminate of whether the point detector bar 5 is in the reverse point position when the reverse point detection signal 91PR is in the indeterminate A, indeterminate B, or indeterminate C regions, as described.

The normal point detection signal 91PN and the reverse point detection signal 91PR are a result of utilizing inductive proximity sensors for the first proximity sensor 30 and the second proximity sensor 35, respectively. As is known, inductive proximity sensors externally act much like a variable resistor. They are fed from a voltage source and separated from a metal target such as the point detector target 25 out of its sensing range such that the resulting current is significantly greater than the current with the target in the sensing range. For a NAMUR inductive proximity sensor having a nominal sensing range of 5 mm, the current changes from near the maximum value to the minimum value over a distance of approximately 1 mm. As is also known, such an inductive proximity sensor includes an oscillator having a coil wound on a ferrite core and concentrating an electromagnetic field near the sensing end. When a metal target, such as the point detector target 25, is brought into the sensing field, induced eddy currents act to dampen the oscillations which in turn decreases the current demand from the source. Accordingly, with the sensor very close to the target, current is reduced to that demanded by transistor biasing.

Accordingly, employment of inductive proximity sensors for use with the point detection system of a railway switch machine is advantageous over previously known detection systems. Specifically, inductive proximity sensors in general are of greater complexity than the type of inductive proximity sensors, such as the NAMUR sensor, having trigger circuitry to turn ON an included transistor when the sensor is within the sensing range of a metal target. In addition, inductive proximity sensors in general are three-wire devices with two of the wires serving as power supply connection and the third wire providing access to the included transistor switch which is in common with the positive or negative side of the power supply. The type of inductive proximity sensor, such as the NAMUR sensor, is the simplest form of an inductive proximity sensor having the fewest parts and therefore being the most reliable. Specifically, the inductive proximity sensor employed with the present invention is a two-wire device. It will be appreciated that other types of generally known inductive proximity sensors contain the internal threshold and switching circuitry described herein. With sensors of this type, it is not practical to make the distinction between ON and shorted or OFF and open.

As previously discussed, the first proximity sensor 30 and second proximity sensor 35 are positioned in the housing 17 adjacent the point detector bar 5. There are advantages to placing the proximity sensors 30 and 35 within the housing 17. For example, when proximity sensors are placed at trackside, special brackets are required to mount the sensors and external wiring must be trenched to the machine and it is difficult to protect the wiring from dragging equipment and it is therefore more subject to damage. Also, employing proximity sensors at trackside and not in the housing 17 requires that the installation be done with more precision and often under conditions of bad weather and bad lighting. Installation cost is thus greater than it otherwise would be if the proximity sensors were installed in the housing at the point of manufacture. By mounting the proximity sensors in the housing 17, these difficulties as well as others are overcome.

The first proximity sensor 80 and the second proximity sensor 85 for detecting the lock box 50 when the slide bar 55 is positioned in the normal locked position or the reverse locked position, respectively, operate in a similar manner to the first proximity sensor 30 and second proximity sensor 35, as described herein. For example, the first proximity sensor 80 generates the normal locked detection signal 91LN that is in the first predetermined range 92 to indicate that the slide bar 55 is in the normal locked position or in the second predetermined range 94 to indicate that the slide bar 55 is not in the normal locked position. In addition, the normal locked detection signal 91LN is indeterminate of whether the slide bar 55 is in the normal locked position when the normal locked detection signal 91LN is less than the first predetermined range 92, greater than the first predetermined range 92 but less than the second predetermined range 94, or greater than the second predetermined range 94. In other words, the normal locked detection signal 91LN is indeterminate of the position of the slide bar 55 when located in indeterminate A, indeterminate B, or indeterminate C regions.

Likewise, the second proximity sensor 85 generates the reverse locked detection signal 91LR that is in the first predetermined range 92 to indicate that the slide bar 55 is in the reverse locked position or is in the second predetermined range 94 to indicate that the slide bar 55 is not in the reverse locked position. As previously described for other signal determinations, the reverse locked detection signal 91LR is indeterminate of whether the slide bar 55 is in the reverse locked position when the reverse locked detection signal 91LR is less than the first predetermined range 92, greater than the first predetermined range 92 but less than the second predetermined range 94, or greater than the second predetermined range 94.

It will be appreciated that the various detection signals 91PN, 91PR, 91LN, 91LR have, for simplicity, been described as essentially representing the same curve or graphical representation as determined by the microprocessor 90 upon receipt of the respective signalling information. However, it will be appreciated and understood by one skilled in the art that the detection signals may be individually different and positioned within the same or other incremental values of the ranges 92 and 94 and the indeterminate A, indeterminate B and indeterminate C regions. The common aspect of all the detection signals and the processing thereof for purposes of determining point detector bar and slide bar position and status is that the ranges 92 and 94 and the indeterminate A, indeterminate B and indeterminate C regions allow for a more safe and reliable determination of normal point position, reverse point position, normal locked position and reverse locked position status at essentially all times.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A point detection system for a railway switch machine having a housing, said point detection system comprising:

a point detector bar positionable in a normal point position and a reverse point position;

a point detector target affixed to said point detector bar;

point detecting means positioned within the housing for detecting when said point detector bar is in said normal point position and when said point detector bar is in said reverse point position, said point detecting means including a first proximity sensor for detecting said point detector target when said point detector bar is in said normal point position and a second proximity sensor for detecting said point detector target when said point detector bar is in said reverse point position, said first proximity sensor generating a normal point detection signal and said second proximity sensor generating a reverse point detection signal, said normal point detection signal having a first predetermined range of values to indicate that said point detector bar is in said normal point position and having a second predetermined range of values, which is different from said first predetermined range of values, to indicate that said point detector bar is not in said normal point position, said reverse point detection signal having a third predetermined range of values to indicate that said point detector bar is in said reverse point position and having a fourth predetermined range of values, which is different from said third predetermined range of values, to indicate that said point detector bar is not in said reverse point position; and means for processing point detection information from said normal point detection signal and said reverse point detection signal.

2. The point detection system of claim 1 wherein said first proximity sensor and said second proximity sensor are inductive proximity sensors.

3. The point detection system of claim 1 further including first point mounting means for mounting said first proximity sensor in slidable proximity to said point detector target such that said first proximity sensor is slidably adjustable relative to said point detector target; and second point mounting means for mounting said second proximity sensor in proximity to said point detector target such that said second proximity sensor is slidably adjustable relative to said point detector target.

4. The point detection system of claim 1 wherein said normal point detection signal is indeterminate of the position of said point detector bar when said normal point detection signal has a value which is less than said first predetermined range of values, greater than said first predetermined range of values but less than said second predetermined range of values, or greater than said second predetermined range of values.

5. The point detection system of claim 1 wherein said reverse point detection signal is indeterminate of the position of said point detector bar when said reverse point detection signal has a value which is less than said third predetermined range of values, greater than said third predetermined range of values but less than said fourth predetermined range of values, or greater than said fourth predetermined range of values.

6. A point detection system for a railway switch machine having a housing defining a first side wall and an opposing second side wall, a point detector bar with a first and a second end positionable in a normal point position and a reverse point position, a slide bar positionable in a normal locked position and a reverse locked position, and means for indicating switching and locking data, wherein said point detection system comprises:

a support sleeve, affixed within the housing to the first side wall and the opposing second side wall, for receiving and slidably supporting the first end of the point detector bar therewithin;

means defined in the first side wall of the housing, through which the point detector bar is slidably retained by the first side wall, such that the first end of the point detector bar is slidably captivated within said support sleeve within the housing and the second end of the point detector bar is positioned outside of the housing;

a point detector target integrally engaged with the first end of the point detector bar within the housing; and point detecting means positioned within the housing and coupled to the means for indicating switching and locking data for detecting said point detector target when the point detector bar is positioned in the normal point position and the reverse point position, wherein said point detecting means generates a normal point detection signal that is transmitted to the means for indicating switching and locking data when said point detecting means detects said point detector target with the point detector bar in the normal point position and said point detector means generates a reverse point detection signal that is transmitted to the means for indicating switching and locking data when said point detecting means detects said point detector target with the point detector bar in the reverse point position.

7. The point detection system of claim 6, further including a slot defined by said support sleeve, through which said point detector target is detectable by said point detecting means when said point detector bar is positioned within said support sleeve.

8. The point detection system of claim 6 wherein said point detecting means includes at least one proximity sensor and said point detector target comprises a metallic material.

9. The point detection system of claim 6 wherein said point detecting means includes a first proximity sensor for detecting said point detector target when said point detector bar is in said normal point position and a second proximity sensor for detecting said point detector target when said point detector bar is in said reverse point position.

10. The point detection system of claim 9 wherein said first proximity sensor and said second proximity sensor are inductive proximity sensors.

11. The point detection system of claim 9 further including first point mounting means for mounting said first proximity sensor in slidable proximity to said point detector target such that said first proximity sensor is slidably adjustable relative to said point detector target; and second point mounting means for mounting said second proximity sensor in proximity to said point detector target such that said second proximity sensor is slidably adjustable relative to said point detector target.

12. The point detection system of claim 9 wherein said first proximity sensor generates a normal point detection signal that is transmitted to the means for indicating switching and locking data and said second proximity sensor generates a reverse point detection signal that is transmitted to the means for indicating switching and locking data.

13. The point detection system of claim 12 wherein said normal point detection signal is in a first predetermined range to indicate that said point detector bar is in said normal point position and is in a second predetermined range to indicate that said point detector bar is not in said normal point position.

14. The point detection system of claim 13 wherein said normal point detection signal is indeterminate of the position of said point detector bar when said normal point detection signal is less than said first predetermined range, greater than said first predetermined range but less than said second predetermined range, or greater than said second predetermined range.

15. The point detection system of claim 12 wherein said reverse point detection signal is in a first predetermined range to indicate that said point detector bar is in said reverse point position and is in a second predetermined range to indicate that said point detector bar is not in said reverse point position.

16. The point detection system of claim 15 wherein said reverse point detection signal is indeterminate of the position of said point detector bar when said reverse point detection signal is less than said first predetermined range, greater than said first predetermined range but less than said second predetermined range, or greater than said second predetermined range.

17. The point detection system of claim 6, further including a slide bar target integrally engaged with the slide bar within the housing; and lock detecting means, coupled to the means for indicating switching and locking data, for detecting said slide bar target when the slide bar is positioned in the normal locked position and the reverse locked position, wherein said lock detecting means generates a normal locked detection signal and a reverse locked detection signal that is transmitted to the means for indicating switching and locking data when said slide bar target is detected in the normal locked position and the reverse locked position, respectively.

18. The point detection system of claim 17 wherein said lock detecting means includes a first proximity sensor for detecting said slide bar target when the slide bar is positioned in the normal locked position and a second proximity sensor for detecting said slide bar target when the slide bar is positioned in the reverse locked position.

19. The point detection system of claim 18 wherein said first proximity sensor and said second proximity sensor are inductive proximity sensors.

20. The point detection system of claim 18 further including first lock mounting means and second lock mounting means for mounting said first proximity sensor and said second proximity sensor, respectively, in slidable proximity to said slide bar target such that respective said first proximity sensor and said second proximity sensor are slidably adjustable relative to said slide bar target.

21. The point detection system of claim 18 wherein said first proximity sensor generates said normal locked detection signal that is transmitted to the means for indicating switching and locking data and said second proximity sensor generates said reverse locked detection signal that is transmitted to the means for indicating switching and locking data.

22. The point detection system of claim 21 wherein said normal locked detection signal is in a first predetermined range to indicate that said slide bar is in said normal locked position and a second predetermined range to indicate that said slide bar is not in said normal locked position.

23. The point detection system of claim 22 wherein said normal locked detection signal is indeterminate of the position of said slide bar when said normal locked detection signal is less than said first predetermined range, greater than said first predetermined range but less than said second predetermined range, or greater than said second predetermined range.

24. The point detection system of claim 21 wherein said reverse locked detection signal is in a first predetermined range to indicate that said slide bar is in said reverse locked position and a second predetermined range to indicate that said slide bar is not in said reverse locked position.

25. The point detection system of claim 24 wherein said reverse locked detection signal is indeterminate of the position of said slide bar when said reverse locked detection signal is less than said first predetermined range, greater than said first predetermined range but less than said second predetermined range, or greater than said second predetermined range.

* * * * *

UNITED STATES PATENT AND TRADEMARK OFFICE

CERTIFICATE OF CORRECTION

PATENT NO. : 6,296,208 B1
DATED : October 2, 2001
INVENTOR(S) : Raymond C. Franke It is certified that error appears in the above-identified patent and that said Letters Patent is hereby corrected as shown below:

Column 5,
Line 3, -- 5 -- should follow "detector bar".

Signed and Sealed this

Sixth Day of August, 2002

*Attest:*

*Attesting Officer*

JAMES E. ROGAN
*Director of the United States Patent and Trademark Office*